US009561144B2

(12) United States Patent
Møller

(10) Patent No.: US 9,561,144 B2
(45) Date of Patent: Feb. 7, 2017

(54) EQUIPMENT FOR THE RAISING OF A LYING PERSON

(71) Applicant: Liftup A/S, Støvring (DK)

(72) Inventor: Anders Lykkegaard Møller, Sønderborg (DK)

(73) Assignee: Liftup A/S, Støvring (DK)

( * ) Notice: Subject to any disclaimer, the term of this patent is extended or adjusted under 35 U.S.C. 154(b) by 0 days.

(21) Appl. No.: 14/437,446

(22) PCT Filed: Oct. 23, 2013

(86) PCT No.: PCT/DK2013/000071
§ 371 (c)(1),
(2) Date: Apr. 21, 2015

(87) PCT Pub. No.: WO2014/063705
PCT Pub. Date: May 1, 2014

(65) Prior Publication Data

US 2015/0290057 A1 Oct. 15, 2015

(30) Foreign Application Priority Data

Oct. 23, 2012 (DK) ..... 2012 00651

(51) Int. Cl.
*A47C 13/00* (2006.01)
*A47C 1/00* (2006.01)
(Continued)

(52) U.S. Cl.
CPC ..... *A61G 5/14* (2013.01); *A61G 1/003* (2013.01); *A61G 1/013* (2013.01); *A61G 1/017* (2013.01);
(Continued)

(58) Field of Classification Search
CPC ..... A61G 1/013; A61G 1/017; A61G 7/1011; A61G 7/1088; A61G 7/109; A61G 7/1074; A61G 7/1038
(Continued)

(56) References Cited

U.S. PATENT DOCUMENTS 2,394,245 A 6/1942 Koller
3,137,511 A 6/1964 Weil et al.
(Continued)

FOREIGN PATENT DOCUMENTS

CN 101816601 A 9/2010
CN 201684092 U 12/2010
(Continued)

OTHER PUBLICATIONS

International Search Report for PCT/DK2013/000071 dated Mar. 4, 2014.

*Primary Examiner* — Rodney B White
(74) *Attorney, Agent, or Firm* — Knobbe Martens Olson & Bear LLP

(57) ABSTRACT

Equipment for raising of a lying person. The equipment comprises: a seat (1), a backrest (2), which from a first position can be passed to a second position behind the back of the person, and a chassis (3) with an upper end to which the seat is connected and a lowermost end adapted to rest on a surface such as a floor. The equipment is to be placed on the surface positioned to the person such that the seat is placed under the behind of the person and from this first position the equipment with the person can be passed to a second position in which the chassis with its lower end rests on the surface such that the seat and backrest is raised relative to the surface e.g. to take a chair-like posture or a catapult position i.e. an upright position in which the person will be assisted to a standing position.

11 Claims, 4 Drawing Sheets

Figure 1:
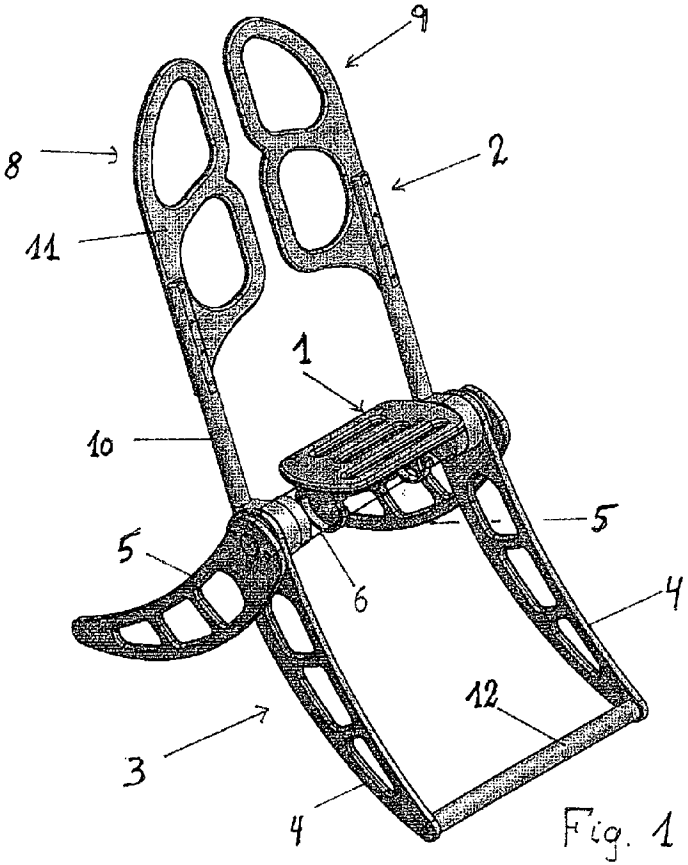

(51) Int. Cl.

| | |
|---|---|
| ***A61G 5/00*** | (2006.01) |
| ***A61G 5/04*** | (2013.01) |
| ***A61G 5/08*** | (2006.01) |
| ***A61G 5/14*** | (2006.01) |
| ***A61G 7/10*** | (2006.01) |
| ***A61G 7/16*** | (2006.01) |
| ***A61G 1/003*** | (2006.01) |
| ***A61G 1/013*** | (2006.01) |
| ***A61G 1/017*** | (2006.01) |

(52) U.S. Cl.
CPC ..... *A61G 7/109* (2013.01); *A61G 7/1011* (2013.01); *A61G 7/1088* (2013.01); *A61G 7/1038* (2013.01); *A61G 7/1074* (2013.01)

(58) Field of Classification Search
USPC ..... 297/52, 118, 330; 5/81.1 R, 83.1, 87.1
See application file for complete search history.

(56) References Cited

U.S. PATENT DOCUMENTS 3,271,796 A * 9/1966 Dillman ..... A47C 3/16 5/625
3,921,231 A 11/1975 Bourgraf et al.
4,173,372 A * 11/1979 Norris ..... A61G 15/02 297/330 X
4,249,774 A * 2/1981 Andreasson ..... A61G 5/14 297/330 X
4,393,529 A * 7/1983 Britz ..... A61G 5/00 5/81.1 R
4,432,359 A * 2/1984 James ..... A61G 7/1059 5/81.1 R
4,987,620 A * 1/1991 Sharon ..... A61G 5/006 5/81.1 R
5,023,968 A * 6/1991 Diehl ..... A61G 1/017 5/81.1 R
5,096,008 A 3/1992 Mankowski
5,193,633 A * 3/1993 Ezenwa ..... A61G 5/006 5/81.1 R
5,355,538 A * 10/1994 Fulford ..... A61G 7/1046 5/81.1 R
5,572,756 A * 11/1996 Muuranen ..... A61G 1/017 296/20
5,896,602 A * 4/1999 Marblestone ..... A61G 7/1019 5/81.1 R
6,131,215 A * 10/2000 Lindell ..... A61G 5/006 5/607
6,154,899 A * 12/2000 Brooke ..... A61G 5/006 5/81.1 R
6,336,235 B1 * 1/2002 Ruehl ..... A61G 7/002 297/354.13
6,381,781 B1 * 5/2002 Bourgraf ..... A61G 1/0565 296/20
6,427,270 B1 * 8/2002 Blevins ..... A61G 5/006 5/87.1 X
6,691,349 B2 * 2/2004 Blevins ..... A61G 5/006 5/81.1 R
6,834,402 B2 * 12/2004 Hanson ..... A61G 7/1026 5/81.1 R
D518,303 S * 4/2006 Vira ..... D6/368
7,578,012 B2 * 8/2009 Palay ..... A61G 3/02 5/81.1 R
7,740,309 B2 * 6/2010 Mayercheck ..... A47C 4/14 297/52 X
8,316,480 B2 * 11/2012 Burak, Jr. ..... A61G 7/1019 5/87.1 X
8,745,791 B1 * 6/2014 Ullrich ..... A61G 1/017 5/625
9,021,633 B2 * 5/2015 Chun ..... A61G 7/1019 5/611
9,084,707 B2 * 7/2015 Patterson ..... A61G 7/1019
2007/0028381 A1 * 2/2007 Palay ..... A61G 7/053 5/81.1 R
2013/0269103 A1 * 10/2013 Van Oirschot ..... A61G 7/1025 5/83.1

FOREIGN PATENT DOCUMENTS

| | | | |
|---|---|---|---|
| EP | 0 707 843 | A1 | 10/1995 |
| GB | 2 413 953 | A | 11/2005 |
| JP | 2002-17785 | A | 1/2002 |
| WO | WO 02/15834 | A1 | 2/2002 |
| WO | WO 2010/096636 | A1 | 8/2010 |

* cited by examiner

EQUIPMENT FOR THE RAISING OF A LYING PERSON

CROSS REFERENCE TO RELATED APPLICATIONS

This application is a U.S. National Phase Application of PCT International Application Number PCT/DK2013/000071, filed on Oct. 23, 2013, designating the United States of America and published in the English language, which is an International Application of and claims the benefit of priority to Danish Patent Application No. PA 2012 00651, filed on Oct. 23, 2012. The disclosures of the above-referenced applications are hereby expressly incorporated by reference in their entireties.

The invention relates to an equipment which can be used to raise a person lying on a solid surface such as a floor.

The invention is based on the difficulty related to raise an elderly person or a person with reduced mobility that has fallen on a floor. In particular it concerns persons who are physically weakened and do not have sufficient muscles to rise to their feet by their own, or where it will cause consequential damages if the person is trying to get up without assistance. Here it concerns people who basically are vigorous , and for unknown reasons have a fall or stumble across a piece of furniture or something else. Persons falling over due to a heart attack are another matter. Due to inadequate muscles and resilience of the body the person will appear with a "dead weight", and it will be difficult even for the nursing staff to raise the person. At the same time it should be considered that the raising of the person must not cause consequential damages. Here is among others persons who suffer from osteoporosis in mind, where it will be necessary to be careful such that they are not exposed to a bone fracture during the attempt of raising them. Equipment such as lifts for handling of physically weakened persons is known. It can be crane-like lifts running on wheels or ceiling lifts, where the lift is running on a rail fixed in the ceiling or to a special frame. However, these lifts are not particularly practicable to raise a person who has fallen on the floor.

The purpose of the invention is to provide an equipment which is suitable for the raising of a person who has fallen or is lying down for other reasons.

According to the invention this is achieved with an equipment as defined in claim 1, and which comprises a seat and a backrest, which from a first position can be passed to a second position behind the back of the person as well as a chassis with an upper end to which the seat is connected and a lowermost end adapted to rest on a surface such as a floor, where the chassis from a first position can be passed to a second position in which the chassis with its lower end rests on the surface such that the seat and backrest is raised relative to the surface. The equipment should be positioned to the person such that the seat is placed under the behind of the person and the backrest is placed under the back of the person. Upon activation of the chassis the seat and the backrest are moving upwards carrying the person. The given situation determines to which height the person is to be raised to, the equipment can be positioned to take a chair-like position, such that the person takes a sitting position or the equipment can be raised further to what is known as a catapult position, i.e. an upright position in which the person will be assisted to a standing position. Another great advantage of the equipment is that it can be designed to take up a minimum of space when it is used as well as it can be designed to take up a minimum of extra space during use.

Further characteristics of the invention appear from the claims 2-15 and the following description of an embodiment of the equipment according to the invention.

Figure 2:
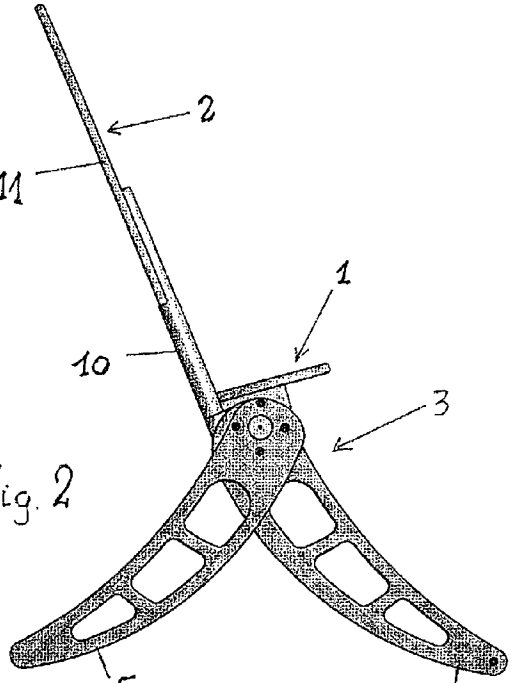
Figure 3:
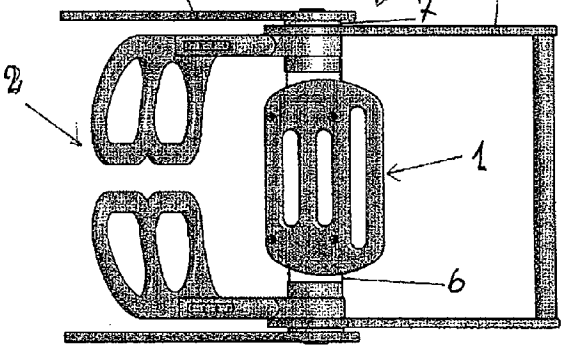

An embodiment of the equipment according to the invention will now be described in details with reference to the accompanying drawings, in which FIG. 1, shows the equipment in a perspective view from the side/front, FIG. 2, shows the equipment directly from one side, FIG. 3, shows the equipment viewed directly from above, and FIGS. 4-11, show a series of images of the equipment in various stages during use.

As it appears from the drawing the main components of the equipment are a seat 1, a backrest 2 and a chassis 3.

The chassis 3 comprises on each side a first leg 4 and a second leg 5, where the first leg 4 on each side is attached to the end of a through travers 6, comprising a drive unit. The second leg 5 is mounted on a bracket 7 at the end of the drive unit. The seat 1 is mounted on the through travers 6. The backrest 2 consists of two separate parts 8,9. The parts 8,9 comprise a shaft 10 which with one end is rotatable embedded in the through travers 6. At the other end of the shaft 10 there is a backrest member 11.

Figure 4:
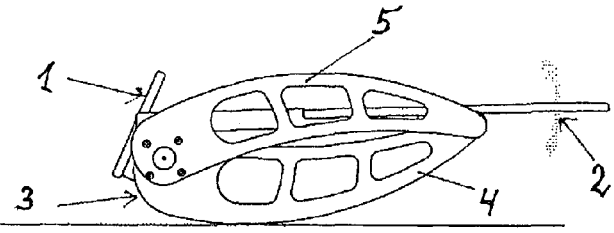
Figure 5:
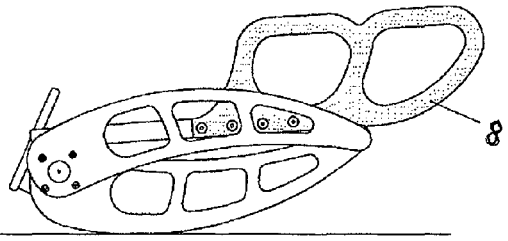
Figure 6:
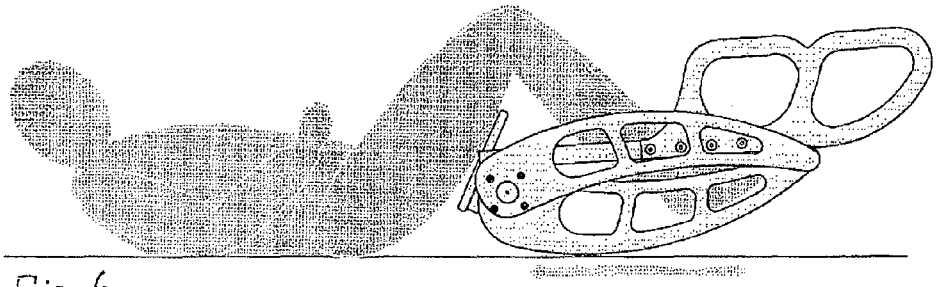
Figure 7:
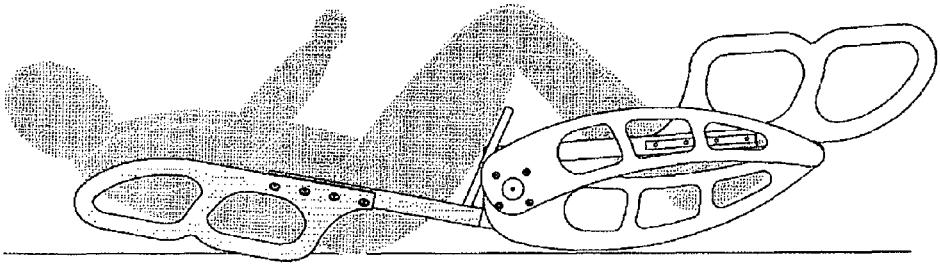
Figure 8:
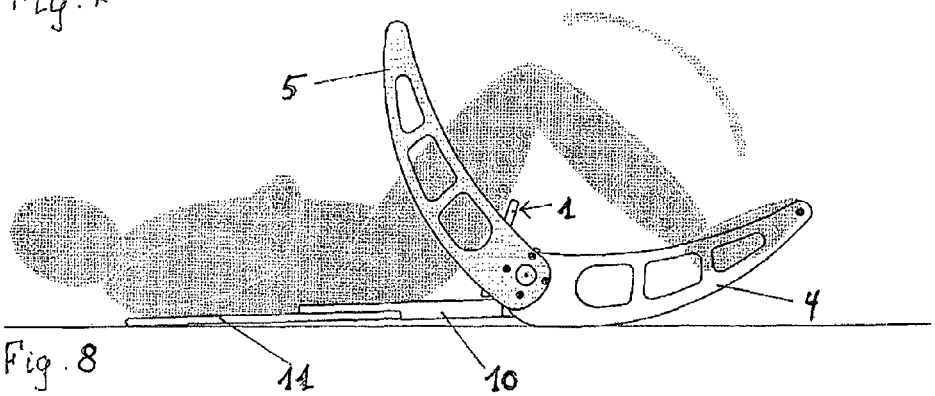
Figure 9:
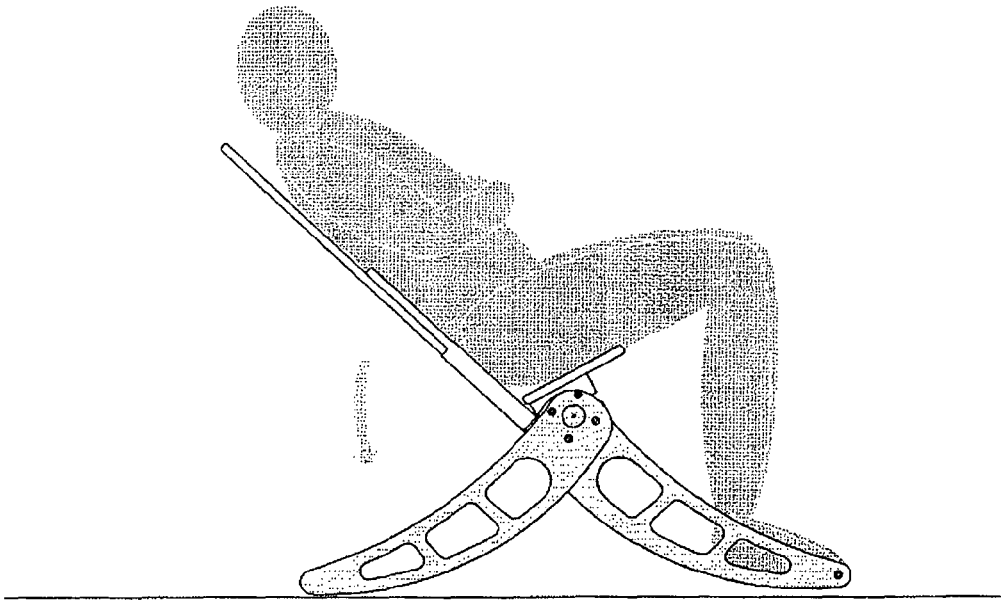
Figure 10:
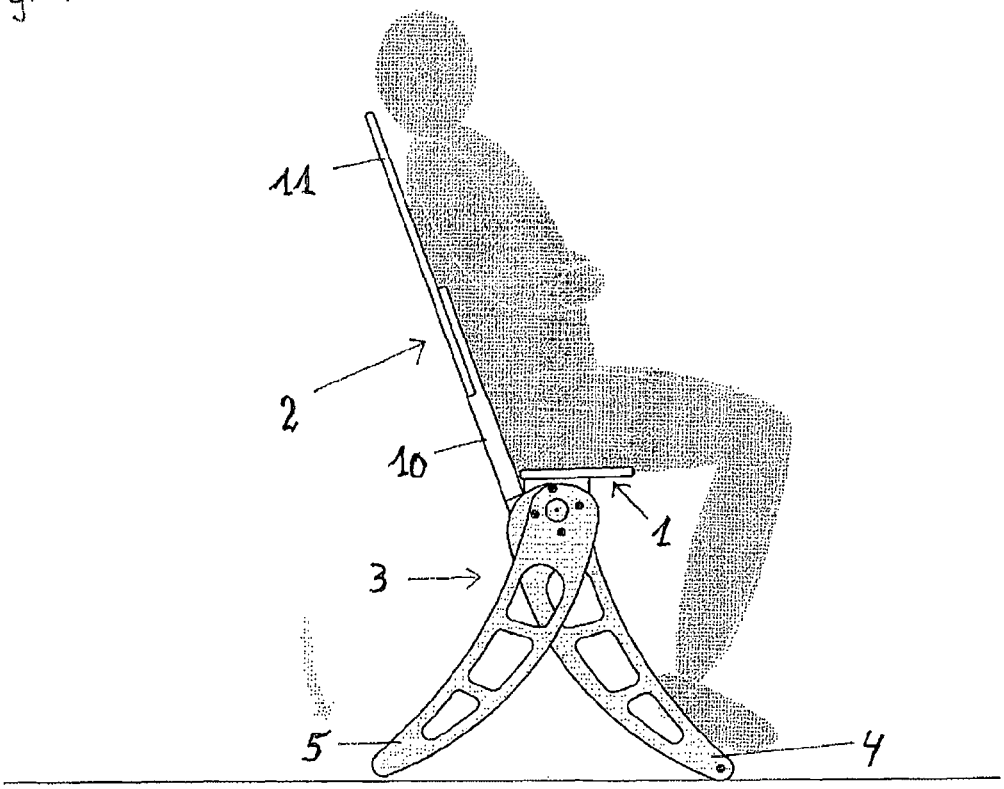
Figure 11:
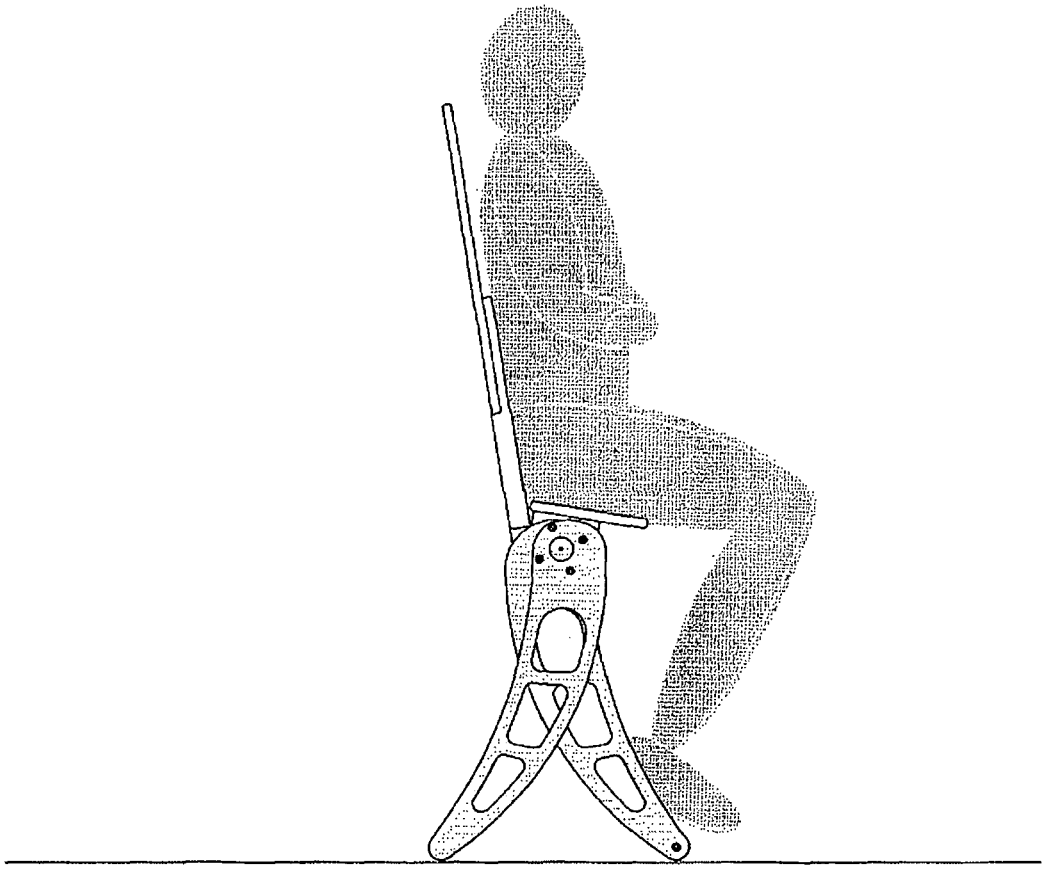

In FIG. 4 the equipment is shown in a collapsed position lying en a surface. In FIG. 5 the parts 8 of the backrest are turned such that the backrest member 11 is in a vertical position. In FIG. 6 the equipment is pushed down under the legs of a person lying on the surface such that the seat 1 rests against the behind of the person. In FIG. 7 one part 8 of the backrest is rotated to a position such that it is located along the side of the person, and in FIG. 8 the part 8 of the backrest is rotated such that the backrest member 11 is positioned behind the back of the person. This is to be repeated with the second part 9 of the backrest. Both parts 8,9 of the backrest can of course be moved at the same time. Alternatively, the two parts 8,9 of the backrest can be interconnected by a shaft such that they move synchronously. However, It should be noted that the backrest members 11 of the two parts 8,9 are moved individually. The person now rests in the equipment. As is appears from FIG. 8 the other leg 5 of the chassis is now rotated along the person and by the further rotation the extremity of the second leg 5 will get into contact with the ground and will with the free end begin to lift upwards the end of the first leg 4 together with the travers 6, the seat 1 and the backrest 3, as the two legs 4,5 is performing a scissor movement until the equipment has assumed a posture as a chair, and thus has raised the person to a sitting position. When the two legs 5 are moved further the equipment will be able to raise the person to a standing position as shown in FIG. 11, also known as "a catapult operation".

It is important to note that the equipment can be stopped and reversed at any time. It may be relevant if it turns out or one suspects that the person has broken for example a leg or an arm during his fall. It might simply also be the case that the person needs a little break during the movement to the raised position.

When the equipment is to be folded after use, the first legs 4 are activated such that it continues to rotate in the same direction until the equipment again appears as shown in FIG. 4.

The two parts 8,9 of the backrest can be locked at least in the position in which they with their backrest member 11 are turned behind the back of the person. The lock can simply be a ball lock. Preferably, the backrest sections 8,9 can also be locked when the equipment is folded, which partly contributes to a precise operation of the equipment, and at the same time is improving the operation as the equipment can be carried and maneuvered in relation to the person by means of the backrest. As it appears from FIG. 4 the backrest members 11 of the backrest extend in the front of the legs 4,5. However the backrest members 11 can be mounted axially displaceable on the shafts 10 and in that way they can be pushed in such that they do not extend or do not extend as much in front of the legs 4,5, when the equipment is folded.

The first leg 4 on each side of the equipment can be connected to a cross member 12 at their lower ends. This contributes to greater stability of the equipment, likewise the cross-member 12 can be exploited during use of the equipment in that the operator of the equipment can support with a foot on the cross member 12. For supporting of the lying person's legs an additional cross member can be mounted upon which the lying person can rest with the back of his ankles.

The drive unit for the second leg 5 on each side of the chassis may consist of two separate electric servomotors. The through travers 6 can be a pipe in which the servomotors are arranged at each ends. The power supply for the servo motors can be rechargeable batteries, which together with a control can be located inside the travers. The operating device can merely be of a simple on/off switch. Alternatively, the drive unit can comprise a single motor which via the shaft drives the second leg 5 on each side of the chassis. It can be a single through shaft or two shafts, one for each of the two legs 5. The electric motor can drive the shaft/shafts via a gear with spur gears, where the motor is placed parallel to the shaft/shafts or the gear may comprise a bevel gear, such that the motor is placed perpendicular to the traverse 6. Another possibility is to use multiple servo motors which are arranged along the drive shaft. This makes it possible to use smaller servo motors such that the drive unit does not become that bulky and finds better space under the seat. A further possibility is to use a "hollow"motor, i.e. an electric motor with a through shaft which drives each of the legs. The drive unit can also be designed to be operated manually, for example with a hand crank in case of power failure. Furthermore, the drive unit can be designed such that the electric servo motor is disengaged when the handle is mounted. This may, for example be achieved in that a gear wheel in the gear mechanism is spring loaded to engage and when the hand crank is mounted the gear wheel is disengaged by pushing it back against the spring load. Alternatively, the drive unit can be designed to be operated with a crank handle only, which furthermore can be a hand wheel. In principle, the equipment could also be manually raised to the chair-like posture e.g. in that it is equipped with a lever handle or lifting straps. However, the motorized version is recognized to be the most gentle for the person to be assisted as a motor drive will have a smooth movement of the equipment without sudden jerks and shocks that could damage the person. Furthermore, it will also be physically hard for the assistants to raise the equipment with the person manually.

The seat 1 can be secured to the travers 6 directly by screws or indirectly by brackets. For example it can be brackets in the shape of pipe brackets that are clamped around the travers 6.

The outer free end of the legs 4,5 can be provided with drive wheels or rollers such that the person can be wheeled on the equipment, for example to a chair or a bed. For operation of the equipment and for safety reasons, at least one of the drive wheels can be locked. Preferably, both wheels on the first legs 4 are lockable. When the second leg 5 on each side of the chassis is provided with drive wheels or rollers these are running across the underlying surface rather than sliding, which requires less effort and energy. This means one can choose a smaller motor and that the rechargeable batteries last longer.

As it appears the legs 4,5 are performed slightly curved, which in itself causes a smooth movement of the legs 4,5 across the surface. However, the edges of the legs 4,5, which comes into contact with the surface can be provided with wheels or rollers such that friction will be decreased when the legs are moved across the surface.

As is appears, the equipment consists of relatively few components, e.g. are the four legs basically identical and the same applies to the two parts of the backrest. The equipment can be manufactured in a variety of materials, e.g. the legs, the seat and the backrest can be manufactured from wood. It is of course also possible to manufacture the equipment in a plastic material, for example a carbon fiber material or metal or a combination of materials.

As it also appears from the drawing the equipment takes up only a small space in the collapsed condition, c.f. FIG. 4. As it also apparent there is only required a minimum of surrounding space for operating the equipment. Basically there is not required more space than a person is occupying.

The invention claimed is:

1. Equipment for the raising of a lying person, which is suitable for the raising of a person who has fallen or is lying down, the equipment comprising:

a seat mounted on a transverse rod;

a backrest having left and right parts individually rotatably connected to both sides of the transverse rod;

a chassis, the chassis comprising a first pair of legs fixedly coupled to both sides of the transverse rod and a second pair of legs movably coupled to both sides of the transverse rod, both pair of legs extending away from the seat and the transverse rod; the second pair of legs movable with respect to the first pair of fixed legs so that the second pair of legs are configured to move to a position that is substantially adjacent to and extending in the same direction as the first pair of fixed legs in a collapsed condition and the first pair of fixed legs contact a floor, wherein both the first pair of fixed legs and the second pair of legs are substantially perpendicular to the seat in the collapsed condition and is configured to be placed underneath the legs of a person who has fallen or is lying down on his back;

the left and right backrest parts being movable from at least a first position where they are adjacent to and extend in the same direction as the first and second pairs of legs in the collapsed condition to a second position where they contact the floor and extend in the opposite direction of the first and second pairs of legs when in the collapsed condition, the left and right backrest parts further being movable to a position underneath the back of a person when the person is lying down on his back;

the chassis configured to move the seat and the left and right backrest parts from the second position where the left and right backrest parts contact the floor to a second position where the seat and the left and right backrest parts are raised relative to the floor in comparison to the first position;

the chassis including at least one electric motor configured to rotate the second pair of legs about the transverse rod around and away from the first pair of fixed legs in the collapsed condition to contact the floor and continue to move toward the first pair of fixed legs to raise the seat and the backrest from the second position.

2. The equipment according to claim 1, wherein a power supply for the at least one electric motor comprises rechargeable batteries, which together with a control, are located inside the transverse rod.

3. The equipment according to claim 1, wherein the first pair of fixed legs and the second pair of fixed legs are slightly curved.

4. The equipment according to claim 1, wherein the equipment is arranged to be passed from the first position to the second position by having the first pair of fixed legs of the chassis rotated along the person and, by further rotation, outer ends of the second pair of fixed legs will come into contact with the ground and, with the outer ends of the second pair of fixed legs, begin to lift upwards the ends of the first pair of fixed legs together with the transverse rod, the seat, and the backrest, as the two pairs of legs are performing a scissor movement until the equipment has assumed a position as a chair.

5. The equipment according to claim 1, wherein the left and right backrest parts of the backrest comprise a shaft having a backrest member which, from a neutral position, can be turned along the back and locked behind the back of the person to be raised from the ground.

6. The equipment according to claim 1, wherein the equipment comprises driving wheels or rollers, such that the person can be transported on the equipment, and wherein the driving wheels or the rollers are lockable.

7. The equipment according to claim 1, wherein a front leg of each of the first pair of fixed legs on each side of the equipment are connected to a cross member at a lowermost end.

8. The equipment according claim 1, wherein the second pair of fixed legs on each side of the chassis has a drive unit, the drive unit consisting of two separate electric servomotors.

9. The equipment according to claim 8, wherein the transverse rod is pipe shaped and wherein the servomotors are placed at each end of the transverse rod and furnished with a power supply and a control.

10. The equipment according to claim 1, wherein the equipment comprises one electric motor, which via at least one shaft, the electric motor drives a rear leg of each pair of fixed legs on each side of the chassis via a gear with spur gears, such that the electric motor is placed parallel to the transverse rod or via a bevel gear, such that the electric motor is placed perpendicular to the transverse rod.

11. The equipment according to claim 1, wherein the equipment is provided with a lever handle or lifting straps for manually raising the equipment to a chair position.

* * * * *